United States Patent [19]

Nishikawa et al.

[11] 4,227,868

[45] Oct. 14, 1980

[54] SINGLE-CURVATURE FAN WHEEL OF DIAGONAL-FLOW FAN

[75] Inventors: Yoshiyasu Nishikawa, Ono; Chosei Harada, Akashi; Masao Nakano, Kobe, all of Japan

[73] Assignee: Kawasaki Jukogyo Kabushiki Kaisha, Kobe, Japan

[21] Appl. No.: 872,459

[22] Filed: Jan. 25, 1978

[30] Foreign Application Priority Data

Jan. 28, 1977 [JP] Japan ..... 52/8947

[51] Int. Cl.[3] ..... F04D 29/30

[52] U.S. Cl. ..... 416/186 R; 416/188; 416/DIG. 2; 416/DIG. 3

[58] Field of Search ..... 416/186, 188, 185, DIG. 3, 416/DIG. 2

[56] References Cited

U.S. PATENT DOCUMENTS

| | | | |
|---|---|---|---|
| 416,070 | 11/1889 | Pelzer | 416/186 |
| 2,054,144 | 9/1936 | Swigert | 416/186 |
| 2,399,852 | 5/1946 | Campbell et al. | 416/185 |
| 2,415,847 | 2/1947 | Redding | 416/219 R |
| 2,965,287 | 12/1960 | Schug | 416/188 |
| 3,168,048 | 2/1965 | Toyokura et al. | 415/207 |
| 3,334,807 | 3/1967 | McMahan | 415/207 |
| 3,515,498 | 9/1968 | Tomita | 416/186 |
| 3,584,968 | 6/1971 | Keith | 416/186 |
| 3,727,593 | 4/1973 | Enke | 416/188 |
| 3,936,225 | 2/1976 | Stjernstrom | 415/210 |
| 4,012,168 | 3/1977 | Spellman | 416/132 |

FOREIGN PATENT DOCUMENTS

| | | | |
|---|---|---|---|
| 1077981 | 3/1960 | Fed. Rep. of Germany | 415/210 |
| 2356025 | 1/1978 | France | 416/186 |
| 62691 | 7/1940 | Norway | 416/188 |

*Primary Examiner*—Everett A. Powell, Jr.
*Assistant Examiner*—A. N. Trausch, III
*Attorney, Agent, or Firm*—Haseltine, Lake & Waters

[57] ABSTRACT

A blade of the fan wheel of a diagonal-flow fan, which blade should ideally have a shape of a twisted double-curvature or undevelopable surface, is formed from a portion of a cylinder, which has a single-curvature or developable surface. To realize the formation of a blade from the single-curvature surface, lines of intersection between a cylinder and a number of coaxial imaginary conical surfaces representing streamlines in the fan wheel are used as a basis for design.

2 Claims, 17 Drawing Figures

SINGLE-CURVATURE FAN WHEEL OF DIAGONAL-FLOW FAN

BACKGROUND OF THE INVENTION

This invention relates generally to fans and blowers for delivering gases at specific flow rates and pressures and more particularly to an impeller or fan wheel of a diagonal-flow fan, the fan wheel being provided with blades each of the shape of a single-curvature surface which affords high performance of the fan substantially equivalent to that of the fan provided with blades each of an ideal shape of a twisted double-curvature surface.

In the fan wheel of an ordinary centrifugal fan the entrance edges and exit edges of the blades are respectively parallel to the rotational shaft axis. At the same time, when the fan wheel is viewed in its axial direction, each of its blades is arcuately curved as it extends toward the periphery of the fan wheel, and each blade has no twist with respect to the axial direction, and cross sections of the blades taken in parallel planes perpendicular to the axis appear to be superposed on each other. Thus, each blade has a single-curvature or developable curved surface.

Furthermore, most of the cross sections of these blades with single-curvature surface in an ordinary centrifugal fan have the shape of a single arc, or the shape of two arcs joined together. Accordingly, the fabrication of these blades is relatively simple. However, even in the case of a blade of this kind, a blade cross section shape in which the radius of the arc varies progressively along the chord length is close to the ideal shape from the viewpoint of fluid dynamics, but the fabrication of blades of such a shape is extremely difficult. For this reason, such blades have not as yet been reduced to practice except for centrifugal fans having blades of wing profiles (airfoil profiles) being manufactured in spite of this difficulty in order to utilize the advantages in efficiency and low noise level.

In contrast to a centrifugal fan as described above, a diagonal-flow fan has blades whose entrance edges and exit edges are not parallel to the rotational shaft axis, the radial distance from the shaft axis to each entrance edge varying progressively from one end of the entrance edge to the other, and furthermore, the radial distance from the shaft axis to each exit edge also varying progressively from one end of the exit edge to the other. In addition, each blade must be provided with a complicated double curvature which causes it to have a twist as viewed in the shaft axial direction. These and other features of diagonal-flow fans will be described in detail hereinafter, particularly in comparison with a centrifugal fan.

Theoretically, a diagonal-flow fan should have excellent performance but has not been reduced to practical use because of certain difficulties as will be described hereinafter.

SUMMARY OF THE INVENTION

It is an object of this invention to provide a fan wheel of a diagonal-flow fan in which, by utilizing a part of a cylinder (a single-curvature surface or developable surface) for each blade of the fan wheel, an effect equivalent to that of blades of double-curvature surfaces which are close to the ideal from the viewpoint of fluid dynamics is attained to produce excellent fan performance, and, moreover, the difficulties accompanying the fabrication of diagonal-flow fan blades are overcome thereby to facilitate the production of the fan wheel.

Other objects and further features of this invention will be apparent from the following detailed description when read in conjunction with the accompanying drawings.

DETAILED DESCRIPTION

As conductive to a full understanding of this invention, the differences between a centrifugal fan and a diagonal-flow fan and certain problems accompanying diagonal-flow fans, which were briefly mentioned hereinbefore, will first be described more fully.

Figure 1:
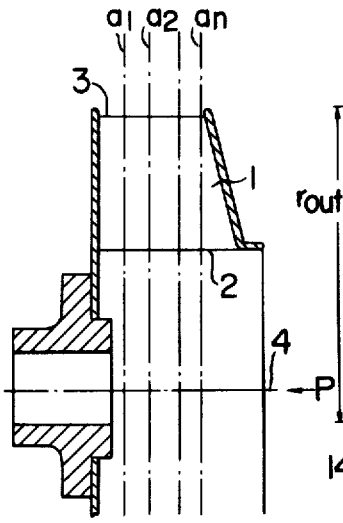
PRIOR ART FIG. 1
FIG. 1 is a partial side view, in section taken along a plane passing through the axis of rotation, of a fan wheel of an ordinary centrifugal fan.
Figure 2:
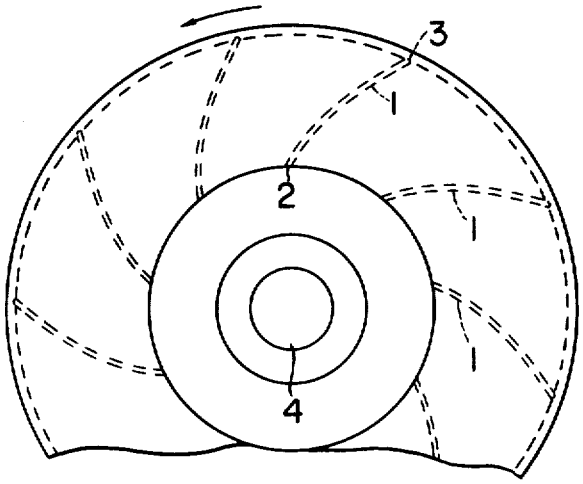
PRIOR ART FIG. 2
FIG. 2 is a partial axial view of the same turba-type centrifugal fan showing the rearwardly curved blade profile.

Referring first to FIG. 1, the fan wheel shown therein of an ordinary centrifugal fan has a number of blades 1, each having an entrance edge 2 and an exit edge 3 both of which are parallel to the rotational shaft axis 4. As viewed in the axial direction (arrow direction P), each blade 1 is arcuately curved as it extends from its entrance edge toward its exit edge or the periphery of the fan wheel as shown in FIG. 2 but has no twist in the direction of the shaft axis 4, and the sections of the blades respectively in spaced apart and parallel planes $a_1, a_2, \ldots a_n$ intersecting the shaft axis 4 at right angles appear to be superposed on each other. That is, each blade 1 may be considered to be a single-curvature surface or developable surface.

Figure 3:
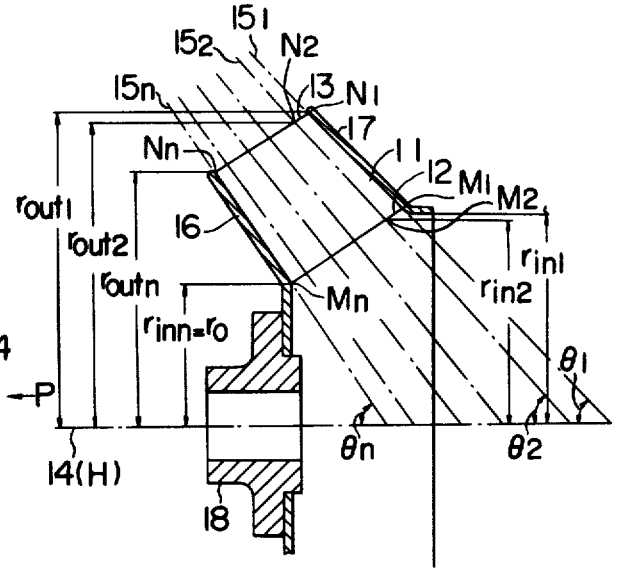
PRIOR ART FIG. 3
FIG. 3 is a side view similar to FIG. 1 showing an example of a fan wheel of a diagonal-flow fan.
Figure 4:
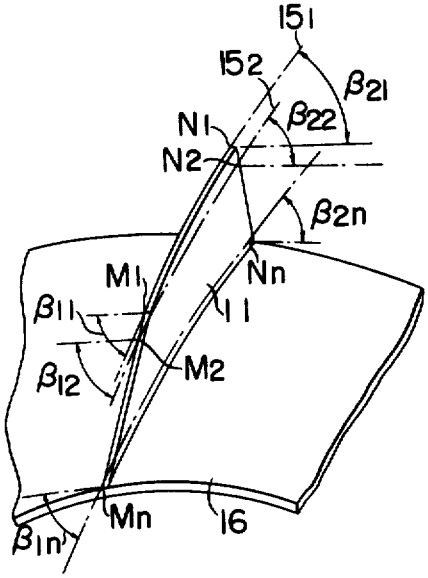
FIG. 4 is a fragmentary perspective view showing a theoretical double twisted blade which can be used in the embodiment of the fan wheel illustrated in FIG. 3.

Differing from a centrifugal fan, a diagonal-flow fan has a fan wheel with blades 11, whose entrance edges 12 and exit edges 13 are not parallel to the rotational shaft axis 14 as shown in FIG. 3, and the radial distance from the shaft axis 14 to the entrance edge 12 of each blade progressively varies as $r_{in1}$, $r_{in2}$, . . . $r_{inn}$ respectively at positions corresponding to representative streamlines $\mathbf{15}_1$, $\mathbf{15}_2$, . . . $\mathbf{15}_n$ in the gas flow path within the fan wheel. Furthermore, the radial distance from the shaft axis 14 to the exit edge 13 of each blade progressively varies as $r_{out1}$, $r_{out2}$, . . . $r_{outn}$. If these radii vary in this manner, the inflow angles at the entrance edge 12 for minimizing the collision loss for respective streamlines $\mathbf{15}_1$, $\mathbf{15}_2$ . . . $\mathbf{15}_n$ and the corresponding outflow angles for evening out the pressure head must be progressively varied as $\beta_{11}$, $\beta_{12}$, . . . $\beta_{1n}$ and $\beta_{21}$, $\beta_{22}$, . . . $\beta_{2n}$, respectively, as indicated in FIG. 4. It will therefore be understood that in order to obtain an ideal fan performance, the shape of each blade must be made to assume a complicated twisted double-curvature surface as viewed in the direction of the axis 14.

That is, if the blades 11 of the fan wheel of the diagonal-flow fan illustrated in FIG. 3 were to be merely of the shape of a single-curvature surface which has a single arcuate curve or a curve comprising two arcuate curves similar to the blades 1 in the centrifugal fan shown in FIG. 1, the fan performance would drop except in the case of extremely small fans. If, in order to improve the performance, an attempt were to be made to fabricate blades 11 of the shape of a twisted, double-curvature surface, the fabrication would be very diffcult.

Similarly as in the case of a centrifugal fan, the use of airfoil profile blades is desirable also in a diagonal-flow fan having double-curvature blades 11 of this character. However, it is impossible production-wise to apply the techniques of fabricating airfoil profile blades, which are difficult to fabricate even in the case of centrifugal fans, to the fabrication of the blades 11 of the shape of a twisted, double-curvature surface of a diagonal-flow fan.

Basically considered, the fan wheels of fans of this character are fabricated, not by casting, but by assembling parts principally of rolled steel plates. Moreover, fans of a wide variety of dimensions, even up to large impellers of diameters of 3 to 4 meters, are produced in a great variety of kinds, each in small quantities. For this reason, it is very difficult to fabricate fan wheels of blades of the shape of a double-curvature surface and airfoil blades at respective costs which are not prohibitive.

Because of the foregoing reasons, centrifugal fans as described have been and are being widely produced, whereas diagonal-flow fans requiring double-curvature blades 11 as shown in FIG. 4 have not been reduced to practice in spite of the great expectations for their high performance.

Before describing the invention, a geometrical analysis of the theoretical shape of the blades of diagonal-flow fans will be made.

As partly described hereinbefore in conjunction with FIG. 3, a plurality of blades 11 are fixed by welding between shroud-like main and side plates 16 and 17, and the main plate 16 at its radially inner part is secured to a hub 18. The representative streamlines $\mathbf{15}_1$, $\mathbf{15}_2$, . . . $\mathbf{15}_n$ (which are actually "streamsurfaces" but will be herein referred to as "streamlines") respectively are in the shapes of conical surfaces of half vertex angles $\theta_1$, $\theta_2$, . . . $\theta_n$. Each blade 11 begins from entrance points (inlets) $M_1$, $M_2$, . . . $M_n$ on these conical surfaces and ends at exit points (outlets) $N_1$, $N_2$, . . . $N_n$. When the conical surface constituted by one ($\mathbf{15}_1$) of the representative streamlines is developed in a planar surface, it appears as in FIG. 5, in which a section of only one blade 11 is shown.

Figure 5:
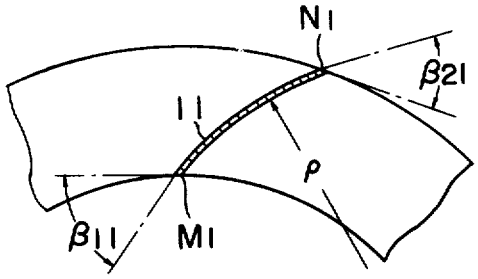
FIG. 5 is a planar development of the blade illustrated in FIG. 4 showing a section through the blade taken along the frusto-conical trace $\mathbf{15}_1$ in FIG. 3.

This section of the blade 11 in FIG. 5 has a specific inflow angle $\beta_{11}$ at the entrance point $M_1$ and a specific outflow angle $\beta_{21}$ at the exit point $N_1$ and, in between, has a shape closely resembling a part of an ellipse and being of gradually varying radius $\rho$ of curvature. The inflow angles and outflow angles of this blade 11 vary as $\beta_{12}$, $\beta_{13}$, . . . $\beta_{1n}$ and $\beta_{22}$, $\beta_{23}$, . . . $\beta_{2n}$, respectively, from their values $\beta_{11}$ and $\beta_{21}$ as indicated in FIG. 4 in correspondence with the representative streamlines $\mathbf{15}_1$, $\mathbf{15}_2$, . . . $\mathbf{15}_n$ shown in FIG. 3. Accordingly, a complicated double-curvature surface is required for each blade 11, as was pointed out hereinbefore.

According to this invention, a shape of the blade close to the above stated ideal shape of the blade is realized by the use of a single-curvature surface without using a complicated double-curvature surface. In order to constitute a single-curvature blade which satisfies the above stated geometrical requirements, this invention makes use of intersections between the above stated conical surfaces constituted by the representative streamlines and an imaginary cylinder.

Figure 6:
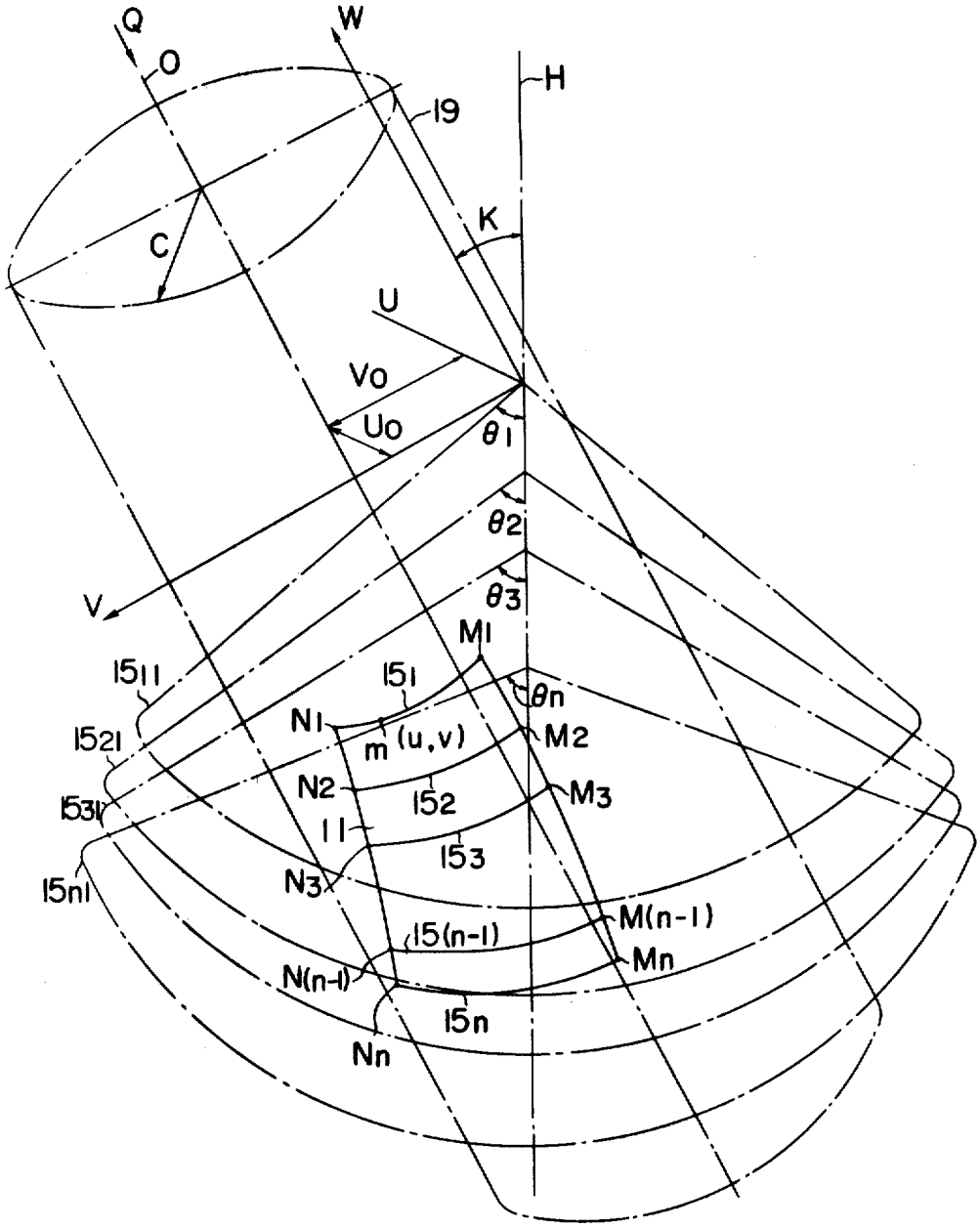
FIG. 6 is a graphical perspective view for a description of the fabrication of the shape for the single curvature blade of the fan wheel according to this invention the intersection of said traces $\mathbf{15}_1$, $\mathbf{15}_2 \ldots \mathbf{15}_n$ with the blade being shown in FIG. 6.
Figure 7A:
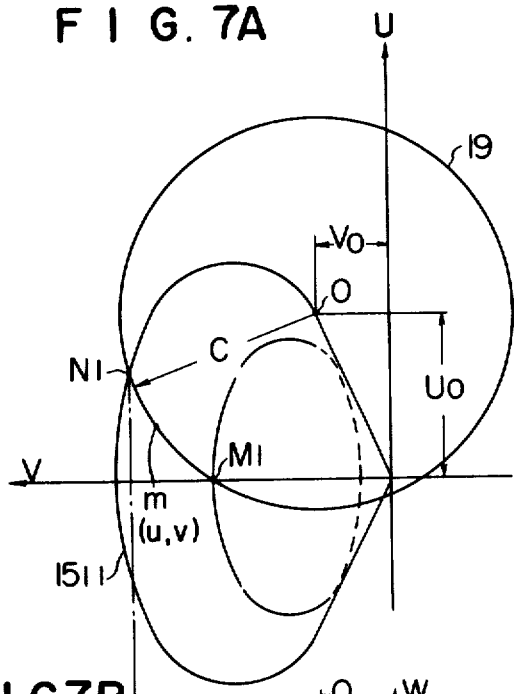
FIGS. 7A, 7B and 7C are respectively views explanatory of the basic principle of this invention for a turbo-type blade.
Figure 7B:
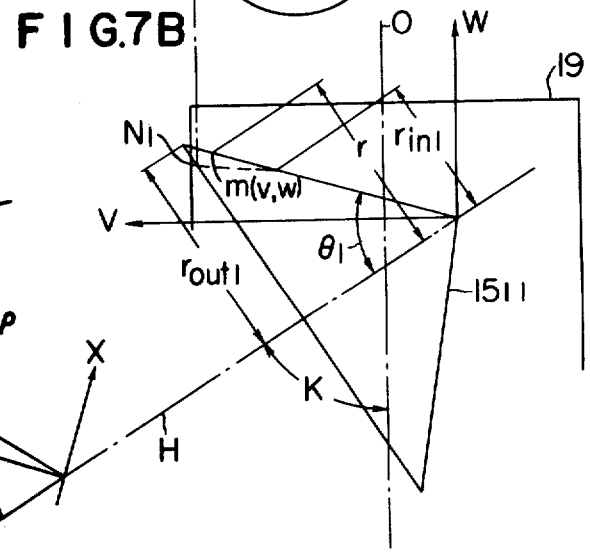
Figure 7C:
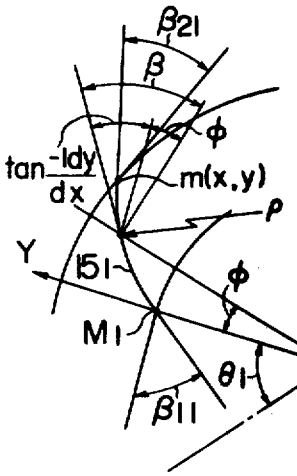

For simplicity, there are shown, in FIGS. 7A through 7C, a single conical surface $\mathbf{15}_{11}$ and an imaginary cylinder 19 intersecting the conical surface to form a line of intersection $\mathbf{15}_1$. According to this invention, a number of the intersections $\mathbf{15}_1$, $\mathbf{15}_2$, . . . $\mathbf{15}_n$ are used which are formed by the single cylinder 19 and a number of the conical surfaces $\mathbf{15}_{11}$, $\mathbf{15}_{21}$, . . . $\mathbf{15}_{n1}$ as shown in FIG. 6.

For the following analysis, three-dimensional rectangular coordinate axes U, V, and W as shown in FIGS. 6 and 7 are used, the origin of this coordinate system being positioned at the vertex of the conical surface $\mathbf{15}_{11}$. The W axis is parallel to the centerline 0 of the cylinder 19, and the V axis passes through the entrance point $M_1$ mentioned hereinbefore when viewed in the direction of the W axis as in FIG. 7A.

The centerline 0 of the cylinder 19, which has a radius C, is at a distance $U_o$ from the V axis and at a distance $V_o$ from the U axis. The W axis is inclined by an angle K relative to the centerline axis H of the conical surface $\mathbf{15}_{11}$ of the half vertex angle $\theta_1$. In the above described state, the cylinder 19 intersects the conical surface $\mathbf{15}_{11}$.

As above stated, the conical surface $\mathbf{15}_{11}$ is the same as the conical surface constituted by the representative streamline $\mathbf{15}_1$ in FIG. 3. Of the line of intersection between this conical surface $\mathbf{15}_{11}$ and the cylinder 19, the part from the entrance point $M_1$ to the exit point $N_1$ is indicated by a thick line on development of the conical surface $\mathbf{15}_{11}$ in FIG. 7C, and this is equivalent to the representation in FIG. 5. That is, in FIG. 5, the blade 11 has a specific inflow angle $\beta_{11}$ and a specific outflow angle $\beta_{21}$ on the conical surface of one representative streamline and has a sectional profile in the shape of a smooth curve having a radius of curvature $\rho$ varying progressively along its length. This sectional profile can be obtained geometrically by determining the above described distances $U_o$ and $V_o$, angle K, and radius C by a method described hereinafter.

These relationships will now be geometrically studied. An arbitrary point m on the curve $M_1N_1$ constituting one part of the intersection between the conical surface $15_{11}$ of the representative streamline and the cylinder 19 in FIG. 7 will be considered. This point m has coordinates (u,v) in FIG. 7A, coordinates (v,w) in FIG. 7B, and coordinates (x,y) in the FIG. 7C, the coordinates (x,y) being based on orthogonal coordinate axes X and Y having their origin on the centerline axis H as shown in FIG. 7C. The axis Y is at the angle $\theta_1$ relative to the axis H. In this case, the following relationships were found to exist as a result of our mathematical and geometrical analysis.

$$x = f(\theta_1, u, r) \quad (1)$$
$$y = f(\theta_1, u, r) \quad (2)$$
$$u = f(U_o, V_o, K, \theta_1, C, r) \quad (3)$$
$$\phi = f(\theta_1, u, r) \quad (4)$$

Here, r is the distance of the point m from the centerline axis H as shown in FIG. 7B, and $\phi$ is the angle between the axis Y and a straight line passing through the point m(x,y) and the origin of the axis Y. Therefore, by substituting the equations (1) through (4) respectively into the relationships $$\rho = \left[1 + \left(\frac{dy}{dx}\right)^2\right]^{3/2} \Big/ \frac{d^2y}{dx^2} \quad (5)$$

$$\beta = \tan^{-1}\left(\frac{dy}{dx}\right) + \phi \quad (6)$$

which are derived through differential analysis known in the art, the radius of curvature $\rho$ and the angle $\beta$ at the point m in FIG. 7C are obtained.

When the point m is at the entrance point $M_1$, the corresponding angle $\beta$ coincides with the inflow angle $\beta_{11}$. Similarly, when the point m is at the exit point $N_1$, the corresponding angle $\beta$ coincides with the outflow angle $\beta_{21}$. As the point m is moved from the point $M_1$ to the point $N_1$, the radius of curvature $\rho$ varies gradually. For this reason, the curve from the entrance point $M_1$ to the exit point $N_1$ is an ideal smooth curve differing from the corresponding curve in the blade of a conventional centrifugal fan wheel which comprises a single arc or at the most two arcs connected together.

Thus, the representative streamline $15_1$ shown in FIG. 3 is obtained as indicated in outline form in FIG. 6. In the same manner, the representative streamlines $15_2$, $15_3$, . . . $15_n$ are obtained respectively from the intersections of the cylinder 19 and the conical surfaces $15_{21}$, $15_{31}$, . . . $15_{n1}$ to develop the shape of a single-curvature blade.

Figure 8A:
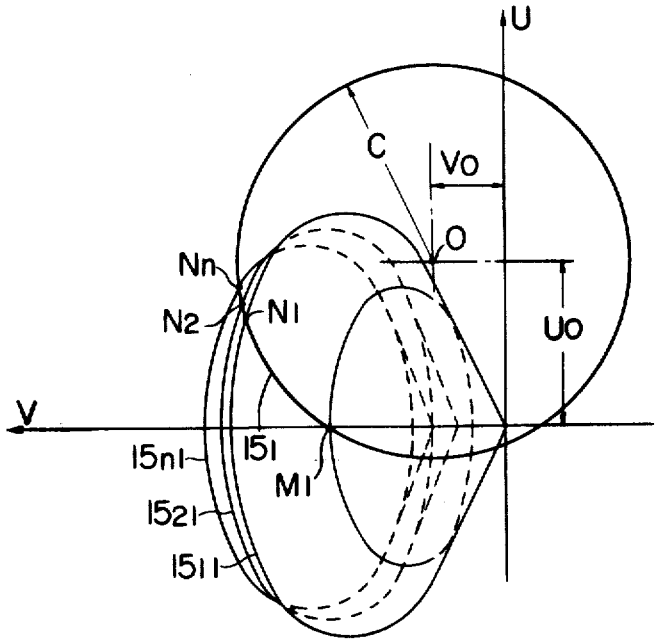
FIGS. 8A and 8B are respectively vertical and horizontal projections of FIG. 6.
Figure 8B:
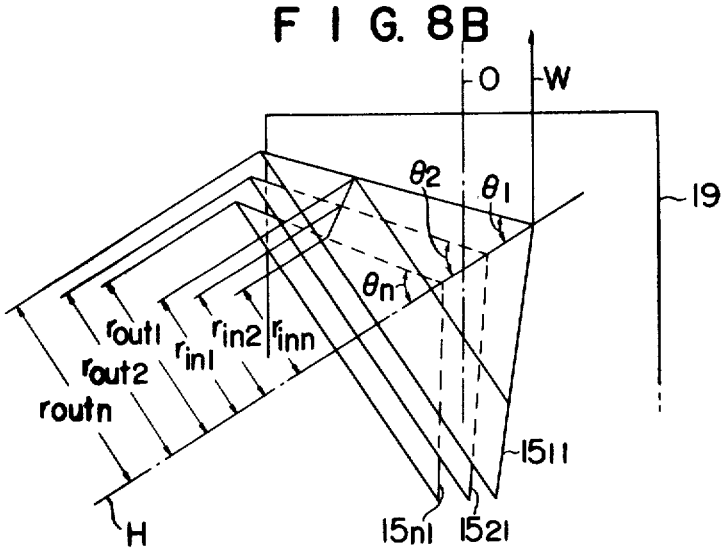

FIG. 8A shows a projection of this state as viewed in the arrow direction Q (FIG. 6). This projection corresponds to FIG. 7A. Furthermore, FIG. 8B is a projection corresponding to FIG. 7B. These intersection lines can be readily computed by carrying out with respect to the conical surfaces $15_{21}$, $15_{31}$, . . . $15_{n1}$ operations similar to that with respect to the conical surface $15_{11}$.

That is, FIGS. 8A and 8B are similar to FIGS. 7A and 7B but further have conical surfaces $15_{21}$, $15_{31}$, . . . $15_{n1}$ having a common centerline axis H with the conical surface $15_{11}$ and respectively having half vertex angles $\theta_2$, $\theta_3$, . . . $\theta_n$. These n conical surfaces $15_{11}$, $15_{21}$, . . . $15_n$ are arranged in the same manner as the n conical surfaces constituted by the representative streamlines $15_1$, $15_2$, . . . $15_n$ in FIG. 3, and, according to this invention, the blade 11 shown in FIG. 3 is obtained as a part of the cylinder 19, delimited by the lines of intersections $15_1$, $15_2$, . . . $15_n$.

As is apparent from FIGS. 6 and 8A, when the group of n conical surfaces inclined as shown is viewed in the axial direction of the cylinder (the arrow direction Q in FIG. 6), the blade 11 coincides with a part of the single curvature surface of the cylinder 19 of the radius C and has no twist, appearing as a superimposition with the same sectional profile. When the conical surface $15_{11}$ is developed into a planar surface, it becomes as shown in FIG. 7C as described before, and the other conical surfaces $15_{21}$, $15_{31}$, . . . $15_{n1}$ also can be similarly developed. The intersections due to these developments are not shown in FIG. 8, but, as indicated in outline form in FIG. 6, they respectively start at points $M_2$, $M_3$, . . . $M_N$ and end at points $N_2$, $N_3$, . . . $N_n$ having inflow angles and outflow angles $\beta_{12}$, $\beta_{22}$, . . . $\beta_{1n}$, $\beta_{2n}$ respectively differing slightly from the inflow angle $\beta_{11}$ and outflow angle $\beta_{21}$ at the streamline $15_1$. Between the entrance and exit points, the intersection lines are in the form of smooth curves having a gradually varying radius of curvature $\rho$.

That the inflow angles $\beta_{11}$, $\beta_{12}$, . . . $\beta_{1n}$ and the outflow angles $\beta_{21}$, $\beta_{22}$, . . . $\beta_{2n}$ respectively differ slightly from each other is a natural result of the variations of the radial distance $r_{in}$ at the entrance point and the radial distance $r_{out}$ at the exit point of each of the representative streamlines $15_1$, $15_2$, . . . $15_n$ as described hereinbefore with respect to FIG. 3.

In designing and producing blades of a diagonal-flow fan according to this invention, the representative streamlines $15_1$ through $15_n$, to be realized are first determined. From these, the conical surface half vertex angles $\theta_1$ through $\theta_n$ are determined. Standard values of the ratio of the inner and outer diameters of each blade have been tentatively determined in accordance with the gas flow rate and the gas delivery pressure, and, therefore, the inflow angles $\beta_{11}$, . . . $\beta_{1n}$ at the blade entrance and the outflow angles $\beta_{21}$, . . . $\beta_{2n}$ at the blade outlet are determined by the fan wheel rotational speed. If an inner diameter $r_o$ of the fan wheel is taken as 1 (unity), the corresponding outer diameter of the fan wheel will be the ratio of the outer and inner diameters.

If the angle K and the radius C have been determined, the coordinates $U_o$ and $V_o$ are unconditionally determined from the coordinates of the entrance point $M_1$ and the inflow angle $\beta_{11}$. Accordingly, the remaining variables are K and C. These two variables K and C are so adjusted that the outflow angle $\beta_{21}$ will take a predetermined value. After thus finally determining the angle K and the radius C as well as the coordinates $U_o$ and $V_o$, it is now possible to plot the entrance and exit points $M_1$ and $N_1$ and to draw the curve $15_1$ on a blank cylinder 19. This curve $15_1$ can be readily determined from the coordinates of the point m, that is, m(u,v,w).

The thus determined positions of the entrance and exit points $M_1$ and $N_1$ on the cylinder become basic reference points from which the plotting of the other entrance and exit points $M_2$, $M_3$, . . . $M_n$ and $N_2$, $N_3$, . . . $N_n$ starts. The next procedure is to determine the positions of the adjoining entrance and exit points $M_2$ and $N_2$ on the line of intersection or curve $15_2$. The determination of the positions of these points $M_2$ and $N_2$ is made by so adjusting the inner and outer radial distances thereof from the shaft axis with respect to the conical surface $15_{21}$, in which the intersection line $15_2$ lies, on the basis of the determined values of the angle K, the radius C and the coordinates $U_o$ and $V_o$ as to obtain the predetermined inflow and outflow angles $\beta_{12}$ and $\beta_{22}$. If the thus determined positions of the points do not coincide substantially with expected positions, a different combination of the values of K and C is adopted and the same procedure as above stated is repeated. Thus, it becomes possible to plot the points $M_2$ and $N_2$ on the blank cylinder 19. The same procedure is repeated for the other conical streamline surfaces to determine the positions of the other points $M_3$, $M_4$, . . . $M_n$ and $N_3$, $N_4$, . . . $N_n$.

For convenience in design, data may be prepared in advance in the above described manner as design information so that, when the inflow and outflow angles and the ratio of the outer and inner diameters of the fan wheel are given, the essential dimensions can be immediately determined. For example, in the case of an inflow angle $\beta_1$, an outer-to-inner diameter ratio $\lambda$, and a conical angle $\theta$, a graph with the angle K as the abscissa and the outflow angle $\beta_2$ as the ordinate and with the cylinder radius C as a parameter may be prepared beforehand.

Figure 9:
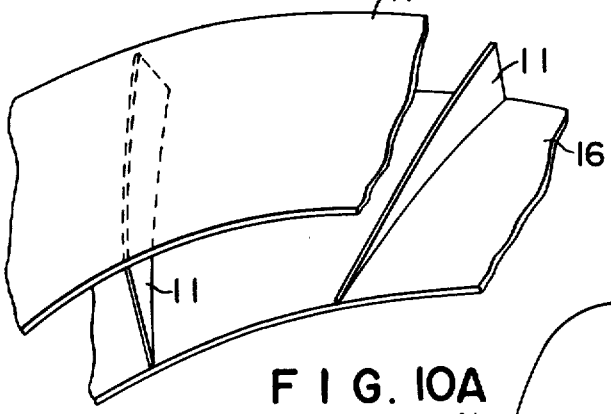
FIG. 9 is a fragmentary perspective view of one part of one example of the single curvature blade for the fan wheel of a diagonal-flow fan according to this invention.

Thus, the actual blade 11 is cut out from a blank cylinder 19 or is formed by bending a piece of plate cut out beforehand from a flat plate stock into a curved shape of a radius of curvature of C. By inserting each blade 11 thus formed between the main plate 16 and the side plate 17 as indicated in FIG. 9 to assemble the fan wheel, a fan wheel of a performance equivalent to that of a fan wheel provided with blades of double-curvature surface, which were considered to be requisite for the fan wheel of a diagonal-flow fan, can be fabricated without the use of such double-curvature blades.

In the above description, the line of intersection $\mathbf{15}_1$ at one end was made a reference curve for a purpose of simplicity. However, in practical design, the reference curve is selected not from the line of intersection at one end but from the line in the middle of the blade. The use of such middle line as a reference curve is advantageous because it represents a mean streamline.

In practice, the plotting of the entrance and exits points as well as the drawing of the contour line of the blade on a blank cylinder can be made manually, but this procedure is most advantageously carried out by a computerized apparatus.

Figure 10A:
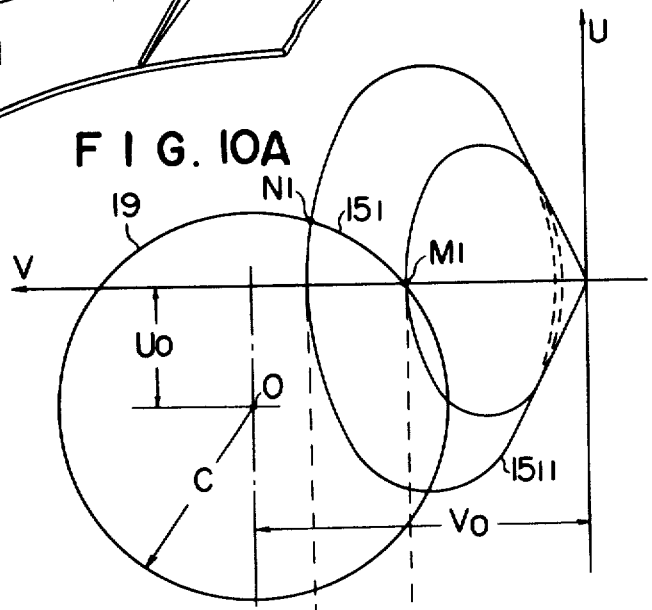
FIGS. 10A, 10B, and 10C are respectively projections for a description of the fabrication of a radial tip type of a fan wheel according to the invention.
Figure 10B:
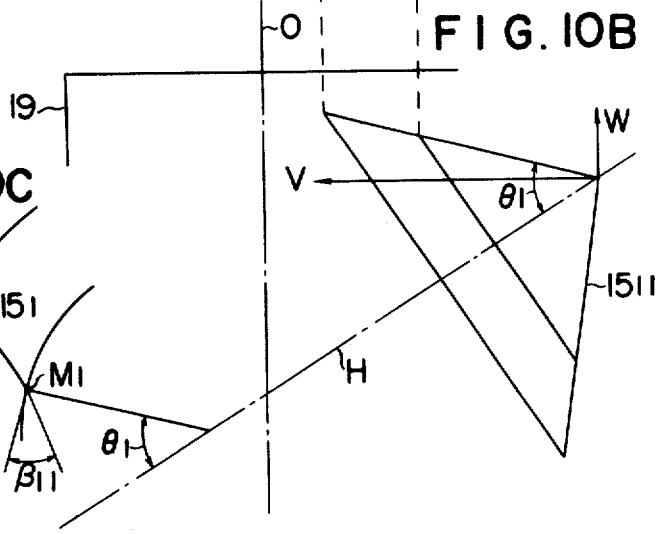
Figure 10C:
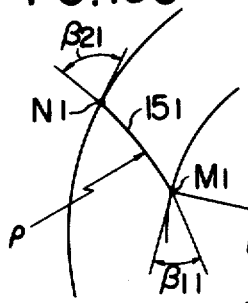

The foregoing description in conjunction with FIGS. 7 and 8 relates to a blade of the so-called "turbo type" wherein the shape of the intersection lines, i.e., the blade 11, faces rearward and, moreover, is curved rearward, but, of course, this blade shape is not thus limited. For example, by placing the cylinder 19 in the positional relationship relative to the conical surface $\mathbf{15}_{11}$ as indicated in FIGS. 10A, 10B, and 10C, a so-called "radial tip type" blade, in which the outflow angle $\beta_{21}$ is a large angle such as 90 degrees or an angle close thereto as indicated in FIG. 10C can be obtained.

In addition, blades of wide ranges of values of the inflow angle $\beta_{11}$ and outflow angle $\beta_{21}$ can be fabricated. Furthermore, as described in conjunction with FIG. 8, it is possible to cause the inflow angles $\beta_{12}$ through $\beta_{1n}$ and the outflow angles $\beta_{21}$ through $\beta_{2n}$ which are necessary for the diagonal-flow fan wheel to respectively vary progressively with respect to the conical surfaces $\mathbf{15}_1$, $\mathbf{15}_2$, . . . $\mathbf{15}_n$ of the other representative streamlines and, moreover, to realize connection of the entrance and exit points with a smooth curve having gradually varying radii $\rho$ of curvature.

Thus, under various design conditions, the conical surfaces respectively corresponding to the representative streamlines $\mathbf{15}_1$ through $\mathbf{15}_n$ are caused to be intersected by a common cylinder 19 of a radius C thereby to produce mutual intersection lines $M_1N_1$, . . . $M_nN_n$, and these intersections are caused to substantially coincide respectively with smooth curves of gradually varying radii $\rho$ of curvature between the inflow angles $\beta_{11}$, $\beta_{12}$, . . . $\beta_{1n}$ and outflow angles $\beta_{21}$, $\beta_{22}$, . . . $\beta_{2n}$ of each blade which are to vary progressively in correspondence with the positions within the gas flow path of the representative streamlines $\mathbf{15}_1$ through $\mathbf{15}_n$ on the conical surfaces thereof and between their entrance points $M_1$ through $M_n$ and exit points $N_1$ through $N_n$.

Upon completion of this preparation, one part of the cylindrical surface of the cylinder 19 is substituted for the blade 11 and, between the main plate 16 and the side plate 17, is fixed thereto by welding, riveting, or some other suitable method. Upon completion of this work for all blades, a fan wheel is obtained. Moreover, since the blade 11 is a portion of the cylinder of radius C, it is in the form of a single-curvature or developable surface and can be readily formed.

Figure 11:
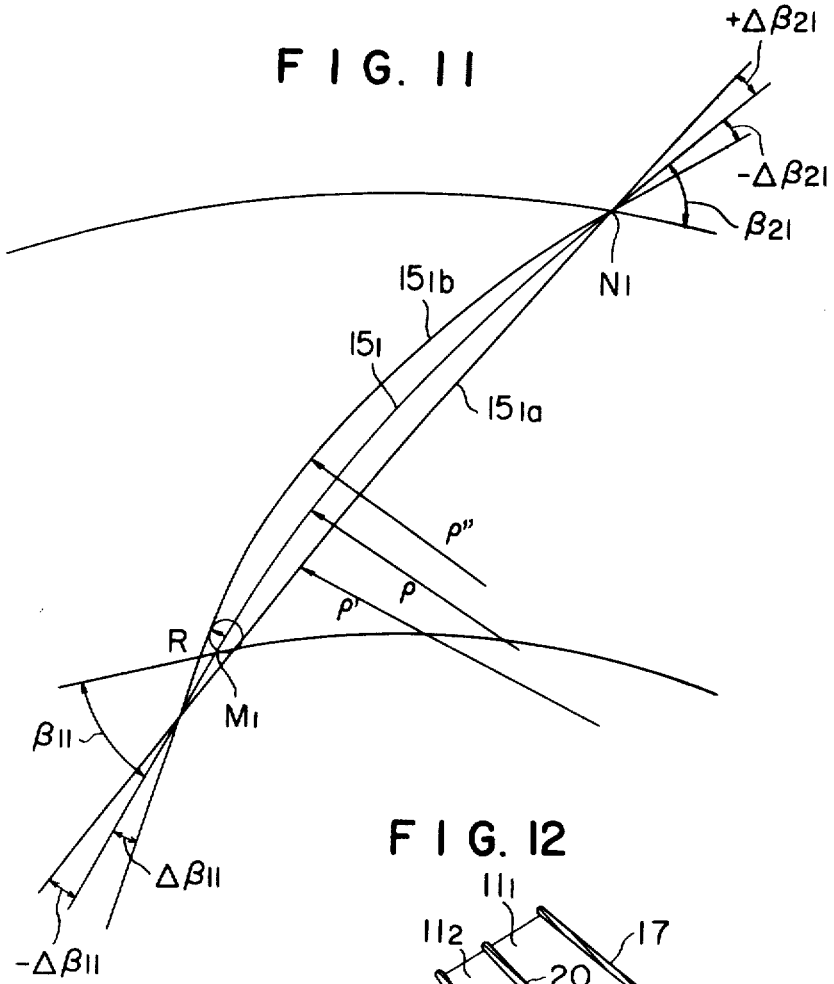
FIG. 11 is a view similar to FIG. 7C but showing how a so-called "airfoil profile" of the blade can be produced.

While the foregoing description relates to only the case where the blade 11 is a thin plate throughout its entire chord length from the entrance points $M_1$ through $M_n$ to the exit points $N_1$ through $N_n$, this invention can be applied also to the fabrication of so-called "airfoil profile" of thick wing profile. A planar development of a conical surface $\mathbf{15}_{11}$ of a representative streamline corresponding to FIGS. 5 and 7C or 10C is shown in FIG. 11. In the description up to this point, the intersection line of this conical surface $\mathbf{15}_{11}$ and a single cylinder 19 was used to form a blade of a thin plate with a camber. An airfoil profile can be obtained in the following manner.

A circle of relatively small radius R is drawn at the entrance point $M_1$. Then, curves $\mathbf{15}_{1a}$ and $\mathbf{15}_{1b}$ will be considered, which are tangent to this circle of the radius R on opposite sides thereof and intersect at a point slightly upstream from the entrance point $M_1$ to form angles $\Delta\beta_{11}$ and $-\Delta\beta_{11}$ with the inflow angle $\beta_{11}$, and which further intersect at the exit point $N_1$ to form angles $\Delta\beta_{21}$ and $-\Delta\beta_{21}$ with the outflow angle $\beta_{21}$ and have gradually varying radii $\rho$ of curvature. The distances $U_o$ and $V_o$, the angle K, and the radius C are so selected that these curves $\mathbf{15}_{1a}$ and $\mathbf{15}_{1b}$ can be obtained as intersections with cylinders **19*a* and 19*b***.

More specifically, the radii C of the cylinders **19*a* and 19*b*** and their related relative values are so selected that a curve is obtained as an intersection line for each of the curves $\mathbf{15}_{1a}$ and $\mathbf{15}_{1b}$. By this procedure, an airfoil cross sectional profile enclosed by the above mentioned circle of the radius R and the curves $\mathbf{15}_{1a}$ and $\mathbf{15}_{1b}$ are obtained. Similar procedures are repeated for the conical surfaces $\mathbf{15}_{21}$ through $\mathbf{15}_{n1}$ of the representative streamlines.

That is, three respectively common cylindrical surfaces R, **19*a*, and 19*b* are used in this example, and they are caused to intersect the conical surfaces respectively of the representative streamlines $\mathbf{15}_1$ through $\mathbf{15}_n$, and of these, one cylindrical surface R with a small diameter extends along the entrance points $M_1$ through $M_n$, and the remaining two sylindrical surfaces 19*a* and 19*b*** pass tangentially to the cylindrical surface R and respectively through the exit points $N_1$ through $N_n$ to form intersection lines of airfoil profile on the conical surfaces $\mathbf{15}_{11}$ through $\mathbf{15}_{n1}$.

Figure 12:
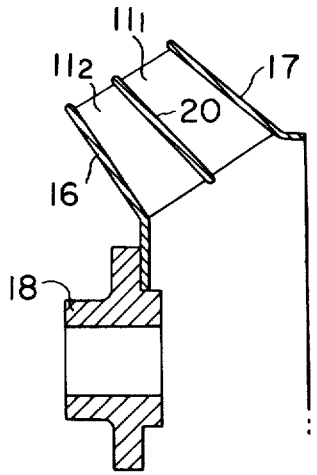
FIG. 12 is a partial side view similar to FIG. 3 showing another example of a fan wheel according to the invention.

FIG. 12 illustrates one example of construction of a fan wheel wherein an intermediate plate 20 of conical shape is further installed between the main plate 16 and the side plate 17 in the fan wheel shown in FIG. 3, and all blades 11 are divided by this intermediate plate 20 into sections $11_1$ and $11_2$. Depending on the circumstances, a plurality of intermediate plates can be similarly installed thereby to divide the blades 11 into a greater number of sections.

The reason for such a measure is that, in the case where the requirements for variations of the inflow angles $\beta_{11}$ through $\beta_{1n}$ and the outflow angles $\beta_{21}$ through $\beta_{2n}$ cannot be satisfied for all of the representative streamlines $15_1$ through $15_n$ related to each blade 11 with only a single cylinder 19, blades produced by intersections with mutually different cylinders are afforded by this measure. Another reason is that, by this construction, the strength of the fan wheel itself is increased by the insertion of the intermediate plate 20. In the case where there is no such requirement, the intermediate plate 20 may be omitted, and, moreover, the plurality of blade sections $11_1$ and $11_2$ may be fabricated unitarily.

In accordance with the embodiments of the invention, as described above, blades each of a single-curvature (developable) surface, which is a portion of a cylindrical surface, are used instead of blades each of double-curvature (nondevelopable) surface, which was heretofore considered to be indispensable, in the fan wheel of a diagonal-flow fan, whereby a fan performance equivalent to that of a fan provided with ideal double-curvature blades can be attained.

That is, the inflow angles and outflow angles of each blade vary progressively in accordance with the positions taken in the gas flow path by the representative streamlines within the fan wheel. In addition, each curve extending from the corresponding entrance point to the exit point also has a shape which is not a simple arc with a single radius of curvature or, at the most, a curve formed by joining two arcs as in centrifugal fans but is a curve which is close to the ideal according to fluid dynamics and has a radius of curvature varying progressively over the entire chord length. Furthermore, the blade shape according to this invention is applicable to not only a blade of the so-called rearwardly curved turbo type, but also to blades of the radial tip type, to combinations of the turbo type and the radial tip type, and even to airfoil types.

We have succeeded in constructing by the above described method a diagonal flow fan having turbo-type, thin plate blades of an outer diameter of 630 mm., a rotational speed of 3,028 rpm, and a delivery pressure rise of approximately 300 mm. of water (Aq) without any difficulty from the beginning, which fan produced a good result of a total pressure maximum efficiency of 83 percent.

Thus, diagonal-flow fans, which were heretofore thought to be very difficult to produce because they required double-curvature blades and, as a result, were not reduced to practice as products although there has been high expectation for their realization as fans of high performance intermediate between centrifugal fans and axial-flow fans, can be produced at low cost in accordance with this invention.

What we claim is:

1. A fan wheel of a diagonal-flow fan for propelling a flow of a gas, said fan wheel comprising a rotational shaft, a frustoconical main plate coaxially fixed to the shaft, a frustoconical side plate spaced apart from the main plate and forming therebetween a diagonal flow path for the gas, and a plurality of fan blades each fixed at respective opposite side edges to the inner surfaces of the main and side plates and having an inner entrance part and an outer exit part, said entrance and exit parts extending transversely with respect to said diagonal flow path, said blades being secured between said frustoconical main and side plates, said frustoconical side plate being coaxially fixed with respect to the axis of rotation of the shaft, the cone angle of the main plate being greater than the cone angle of the side plate, each of said fan blades comprising a curved plate of a surface shape conforming to a portion of a cylindrical surface with a longitudinal axis, said portion being formed of elements constituted by mutual intersection lines between cylindrical surface and successive coaxial conical surfaces varying between said conical surfaces of said main and side plates corresponding to ideal stream surfaces, said coaxial conical surfaces progressively diminishing in cone angle from said main plate to said side plate and having a common axis coinciding with said axis of rotation of the shaft and lying in a plane which is in parallel spaced relationship to said longitudinal axis of the cylindrical surface, said common axis being inclined at an angle with respect to said longitudinal axis when viewed in a direction perpendicular to said plane.

2. A fan wheel as set forth in claim 1, wherein on the basis of a rectangular coordinate system with two axes lying in a plane perpendicular to the longitudinal axis of said cylindrical surface and having its origin at the vertex of one of said conical surfaces, one of said axes lying in a plane which includes a line passing through the vertices of said conical surfaces and is parallel to said longitudinal axis, the coordinate of the longitudinal axis with respect to the other of said axes is positive.

* * * * *